United States Patent [19]

McCarroll

[11] 3,942,887

[45] Mar. 9, 1976

[54] DRIVE MECHANISM FOR A ROLL FUSER EMPLOYED IN A COPIER APPARATUS

[75] Inventor: Alan F. McCarroll, Rochester, N.Y.

[73] Assignee: Xerox Corporation, Stamford, Conn.

[22] Filed: May 28, 1974

[21] Appl. No.: 473,848

[52] U.S. Cl. ..... 355/3 R; 118/70; 219/216

[51] Int. Cl.[2] ..... G03G 15/00

[58] Field of Search ..... 355/3 R, 3 DD, 3 P; 219/216, 469, 470, 471; 118/60, 70, 260; 432/60, 228; 100/155, 176

[56] References Cited

UNITED STATES PATENTS

| | | | |
|---|---|---|---|
| 3,291,466 | 12/1966 | Aser | 355/3 X |
| 3,799,401 | 3/1974 | Braun | 118/70 X |
| 3,810,776 | 5/1974 | Banks | 219/216 |

*Primary Examiner*—Monroe H. Hayes

[57] ABSTRACT

Drive mechanism for a roll fuser employed in a copier apparatus characterized by the provision of input drive means for rotating a fuser roll and also for rotating a backup roll while the two rolls are disengaged, and further characterized by the provision of a flexible drive shaft or coupling for the backup roll which allows for displacement of the backup roll for engagement with the fuser roll. A sump containing offset preventing liquid and means for applying the liquid to the fuser roll structure are disposed beneath the fuser roll structure which, in turn, is positioned below the backup roll. The drive means is so positioned relative to the sump as to preclude contamination therefrom entering the sump.

12 Claims, 7 Drawing Figures

DRIVE MECHANISM FOR A ROLL FUSER EMPLOYED IN A COPIER APPARATUS

BACKGROUND OF THE INVENTION

This invention relates generally to copier apparatus, and, more particularly, to a roll fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

There are various ways of fusing or affixing the toner particles to the support member, one of which is by the employment of heat. In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitute plain paper. Thereafter, as the toner material cools, solidification of the toner material occurs causing the toner material to be firmly bonded to the support member. In both the xerographic as well as the electrographic recording arts, the use of thermo energy for fixing toner images onto a support member is old and well known.

One approach to thermofusing of electroscopic toner images onto a support has been to pass the support with the toner images thereon between a pair of opposed roller members, at least one of which is either externally or internally heated. During operation of a fusing system of this type, the support member to which the toner images are electrostatically adhered is moved through the nip formed between the rolls with the toner images contacting the fuser roll to thereby effect heating of the toner images within the nip. The backup roll of the fuser roll pair is usually constructed so that the fuser roll creates a depression in the backup roll resulting from the bias force which forces the rolls into engagement. Such depression forms an elongated nip which extends the contact time of the toner images with the heated fuser roll structure.

During periods when the copier is not being utilized it is necessary to provide means for preventing the rolls from remaining in engagement. If the foregoing is not provided, the softer backup roll would become flattened in the area of engagement with the fuser roll thereby resulting in problems of proper fusing and paper handling.

One approach to preventing the flattening of the backup roll has been to provide mechanism which effects disengagement of the rolls during inoperative periods of the machine. It will be appreciated that the drive mechanism for imparting rotation to the rolls must accommodate such disengagement with subsequent engagement.

Heretofore, such mechanisms have been very complex and thus quite a bit more expensive both from the standpoint of manufacture and from the standpoint of maintenance during the life of the copying apparatus.

Accordingly, the principal object of this invention is to provide a new and improved copying apparatus.

It is a more particular object of this invention to provide a new and improved roll fusing apparatus for utilization in an electrostatic copier apparatus. Another object of this invention is to provide a roll fusing apparatus which utilizes substantially fewer components than known roll fuser apparatus and which is therefore less costly to manufacture as well as maintain.

Yet another object of this invention is to provide new and improved drive means for a roll fusing apparatus.

A BRIEF SUMMARY OF THE INVENTION

The above-cited objects are accomplished by the provision of a roll fusing apparatus wherein the fuser roll is driven from an input drive means and the backup roll is driven by a flexible shaft prior to engagement with the fuser roll with subsequent driving thereof by virtue of its engagement with the fuser roll. Driving motion is imparted to the backup roll prior to engagement of the two rolls by means of a gear carried by the fuser roll shaft which engages a gear which supports the flexible shaft. The flexible shaft couples the driven gear to the backup roll.

Mechanism not forming a part of this invention is provided for effecting engagement of the backup roll with the fuser roll. The flexible shaft allows the aforementioned mechanism to shift the position of the backup roll from a disengaged position to a fuser roll engaging position. A one way clutch is provided in conjunction with the flexible shaft to prevent overdriving of the backup roll by the fuser roll after engagement of the two.

A sump of release agent is provided for purposes which will be disclosed in conjunction with the detailed description of this invention. In order to prevent contamination from the aforementioned gears falling into the sump of oil which is disposed subadjacent the rolls, the gears are disposed at a location remote from the sump.

Other objects and advantages of the present invention will become apparent when read in conjunction with the accompanying drawings.

DETAILED DESCRIPTION OF THE PREFERRED EMBODIMENT

Figure 1:
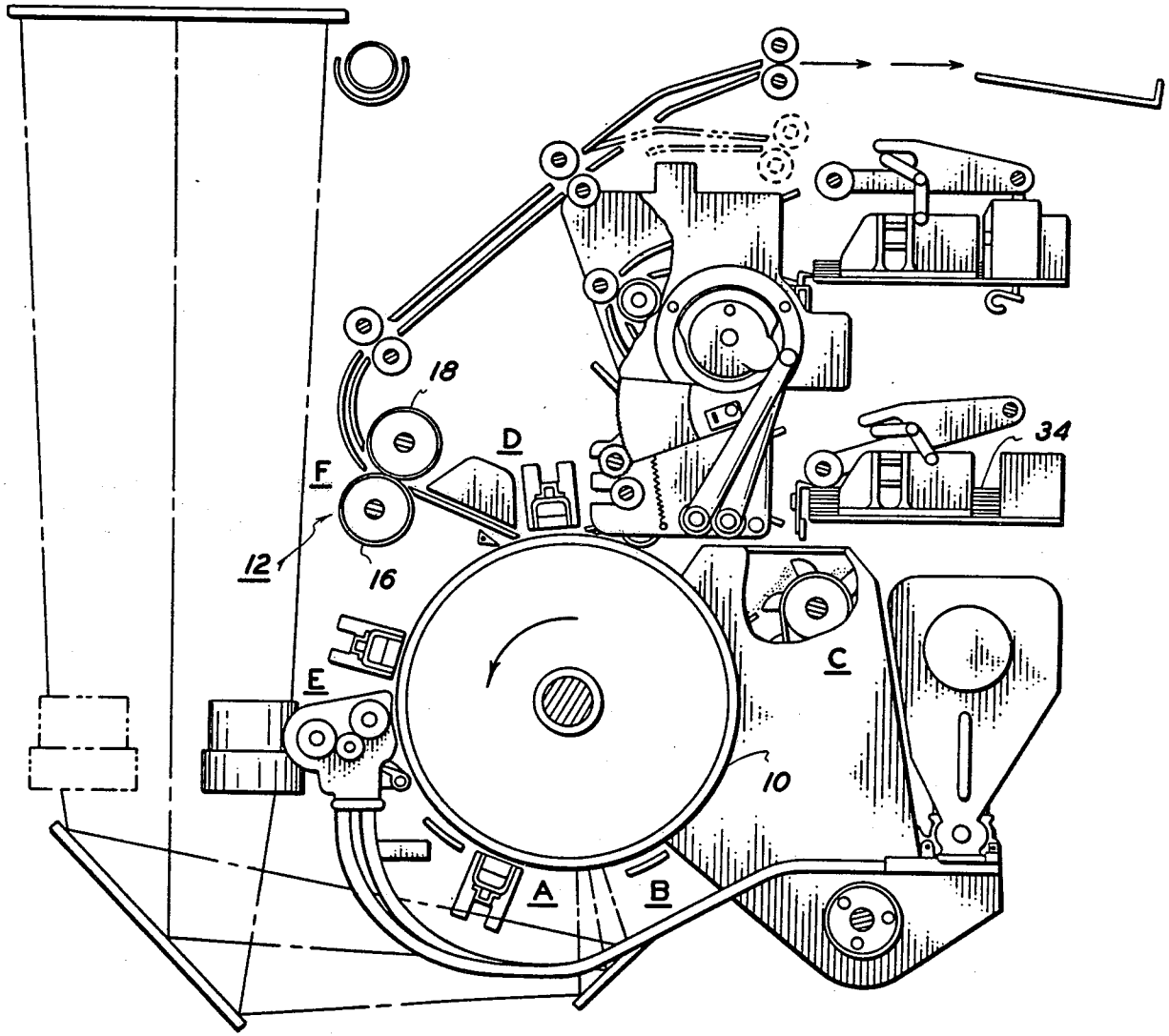
FIG. 1 is a schematic representation of a xerographic reproducing apparatus incorporating the contact fusing system of this invention.

Referring now to the drawings, especially FIG. 1, there is disclosed an automatic xerographic reproducing machine 9 incorporating the roll fuser system of the present invention. The automatic xerographic reproducing machine includes a xerographic plate, or surface 10, formed in the shape of a drum. The plate has a photoconductive layer or light sensitive surface on a conductive backing journaled in a frame to rotate in a direction indicated by the arrow. The rotation will cause the plate surface to sequentially pass a series of xerographic processing stations.

For purposes of the present disclosure the several xerographic processing stations in the path of movement of the plate surface may be described functionally as follows:

a charging station A where a uniform electrostatic charge is deposited onto the photoconductive plate;

an exposure station B, at which light or radiation patterns of copies to be reproduced is projected onto the plate surface to dissipate the charge in the exposed areas thereof, to thereby form latent electrostatic images of the copies to be reproduced;

a developing station C, at which xerographic developing material including toner particles having an electrostatic charge opposite to that of the latent electrostatic images is cascaded over the latent electrostatic images to form powder images in configuration of the copy being reproduced;

a transfer station D, where the powder images are electrostatically transferred from the plate surface to a transfer material such as paper, which then is passed through a heated pressure fusing system according to the present invention as will be described hereinafter; and a drum cleaning and discharge station E, at which the plate surface is brushed to remove residual toner particles remaining thereon after image transfer and at which the plate is exposed to a relatively bright light source to effect substantially complete discharge of any residual electrostatic charge remaining thereon.

For further details of the xerographic processing stations discussed above, reference may be had to U.S. Pat. No. 3,578,859.

Figure 2:
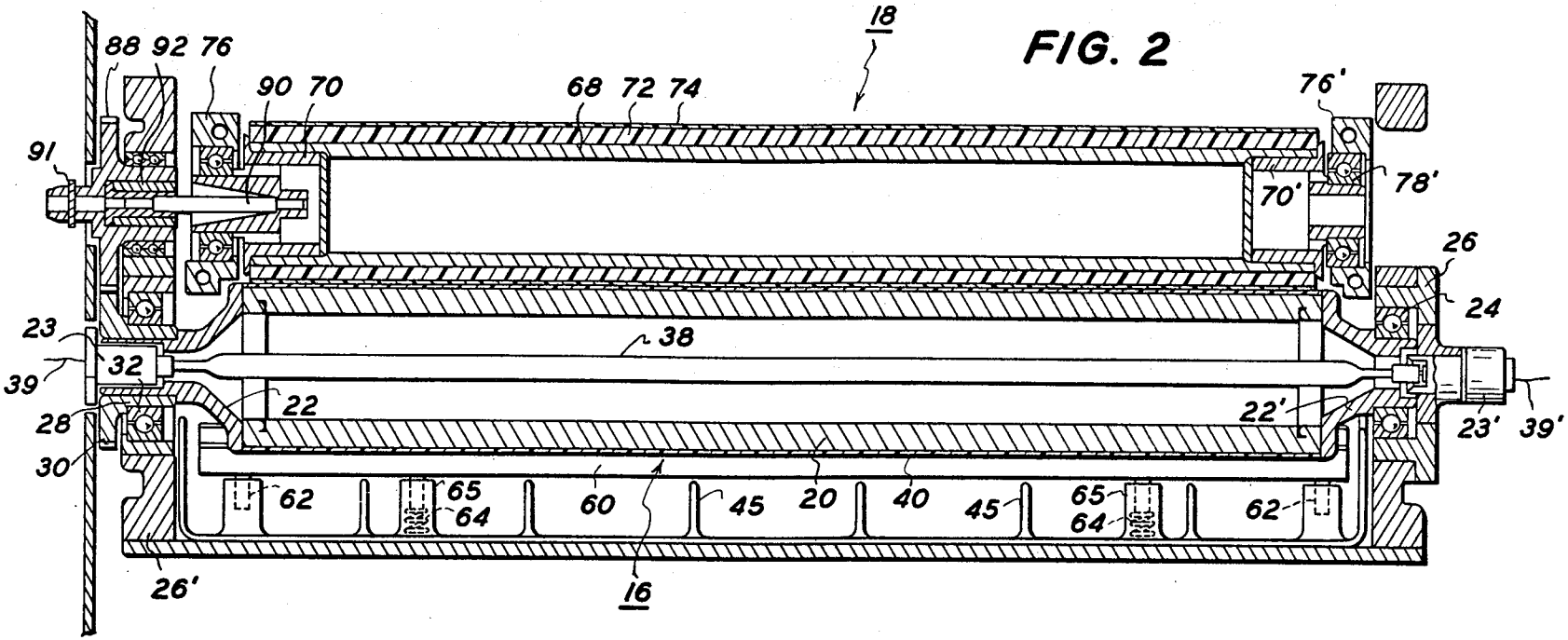
FIG. 2 is a cross-sectional view of the fusing system forming this invention.
Figures 3, 7:
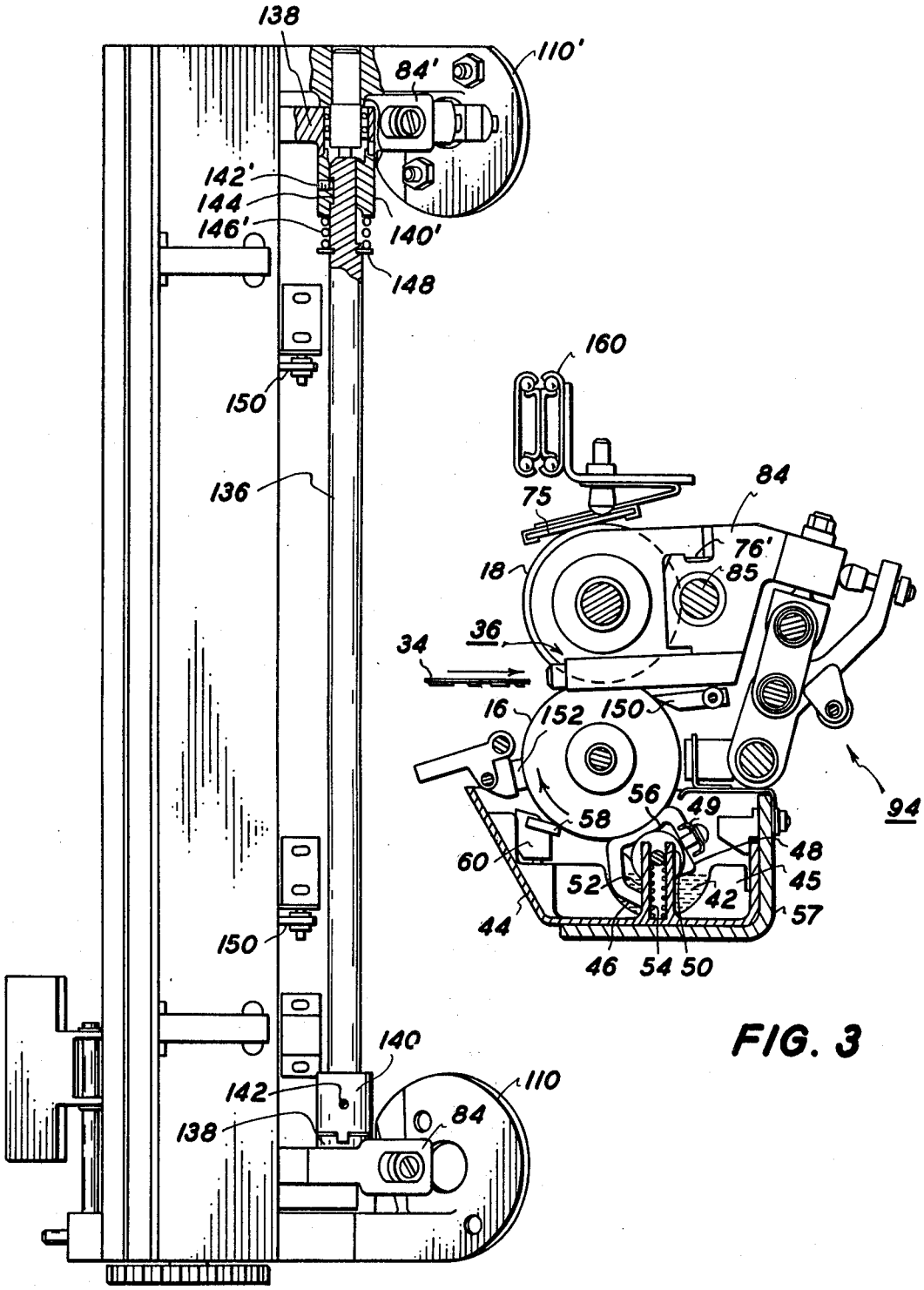
FIG. 3 is a cross-sectional view taken along the line III—III of FIG. 2.
FIG. 7 is a top plan view of the fuser assembly illustrated in FIG. 2.

A combination pressure and heat fusing system 12 as specifically disclosed in FIGS. 2 and 3, comprises a heated fuser roll 16 and a backup roll 18.

The fuser roll structure 16 comprises a rigid cylindrical member 20, preferably fabricated from steel, to which end caps or closures 22 and 22' have been affixed in any suitable manner, for example, by brazing. The member 20 in one operative embodiment has an outside diameter of 2 ⅜ inches. The end cap or closure 22' (FIG. 2) is supported by a bearing 24 carried by a side frame member 26 of the roll fusing assembly 12. The end cap or closure 22 is retained by the hub 28 of a fuser roll drive gear 30 which hub is, in turn, retained or supported by a support bearing 32 disposed in a side frame member 26'.

During operation of the fuser assembly 12 a support copy or sheet 34 (FIG. 3) is moved through the nip 36 formed by engagement of the fuser roll structure 16 and the backup roll structure 18 such that the toner images are contacted by the fuser roll structure 16. In order to provide thermal energy for raising the temperature of the toner particles to a suitable fusing temperature, a heater element 38 is supported internally of the cylindrical member 20 by heater sockets 23 and 23'. The heater element may comprise a quartz heater structure including a quartz envelope having a tungsten resistance heating element disposed internally thereof. In practice power on the order of 1475 watts is supplied to the resistance heating element via electrical connections 39, 39' to thereby raise the surface temperature of the fuser roll to approximately 380°F.

In order to provide the fuser roll structure 16 with an outer surface which has a relatively low affinity for tackified toner particles, a fluorocarbon polymer layer 40 of, for example, tetrafluoroethylene (abbreviated TFE) is provided on the rigid cylindrical member 20. The TFE layer may be on the order of 1.2 – .5 mils thick and the member 20 is preferably fabricated from a thermally conductive material such as copper or aluminum. When copper is employed it should be coated with aluminum or nickel prior to the application of the TFE. The particular manner in which the fuser roll structure 16 is fabricated forms no part of the present invention. Accordingly, such fabrication thereof may be in accordance with well-known processes, for example, those set forth in U.S. Pat. Nos. 3,437,032 and 3,776,760. While the fuser structure is disclosed as having a TFE layer it may be fabricated without the layer and may simply comprise a bare metal surface.

By controlling the heat transfer to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner, whereat the toner particles in the image areas of the toner would liquify and cause a shearing action in the molten toner to thereby result in "hot offset." Shearing occurs when the interparticle or cohesive forces holding the viscous toner mass together are less than the adhesive forces tending to offset it to a contacting surface such as a fuser roll.

Occasionally, however, toner particles will be offset to the fuser roll by an insufficient application of heat to the surface thereof (i.e., "cold" offsetting); by imperfections in the properties of the surface of the rolls; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

To minimize the chance of offsetting toner to the fuser roll a thin layer of organosiloxane polymer or other suitable material is applied to the surface of the fuser roll structure 16 to thereby form an interface between the roll surface and the toner images carried on the support material. Thus a low surface energy layer is presented to the toner as it passes through the fuser nip and thereby minimizes the degree of offsetting of toner to the fuser roll surface.

For the purpose of applying the organosiloxane polymer material, commonly known as silicone oil, to the fuser roll structure 16, a quantity of silicone oil 42 is contained in a sump housing or oil pan 44 forming a part of the fusing assembly 12. Approximately 0.65 liters of silicone oil in the sump provides a level therein which extends to the tops of a plurality of rib members 45. An applicator member 46 is supported within the housing 44 by means of a support member 48 such that the applicator contacts both the silicone oil and the surface of the fuser roll 16. As illustrated in FIG. 3, one end of the applicator member is physically attached to the support member 48 as indicated at 49 while the other end thereof extends into the silicone oil and actually touches the bottom of the sump 44.

The applicator preferably comprises a material which is heat resistant and which is capable of wicking silicone oil from the sump to the fuser roll structure. To this end, the applicator material is preferably a copolymer of meta-phenylenediamine and isophthaloyl chloride which corresponds to a heat-resistant nylon material known under the trademark, Nomex (E.I. du Pont de Nemours & Co.). In addition to applying silicone oil to the fuser roll, the applicator cleans toner therefrom. It has been observed that after extended operation, for example, fusing of 25,000 copies, the portion of the applicator contacting the fuser structure becomes coated with toner but continues to apply silicone oil to the fuser roll.

The support member 48 comprises an elongated construction which is coextensive with the longitudinal axis of the fuser roll structure 16 and has a pair of sidewardly projecting pins 50 and 50' which are received in a pair of upstanding ribs or channels 52 integrally formed or otherwise provided in the sump 44, thereby locating the support member 48 relative to the fuser roll structure. The ribs prevent excessive surging of the oil in the oil pan when the pan is moved and they also act as stiffeners for the oil pan. A pair of bias springs 54 (only one being shown) are also received in the channels 52 for biasing the support member upwardly with a total force of approximately 6 pounds for effecting proper engagement of the applicator with the fuser roll structure.

The periphery of the support member 48 is provided with a plurality of concave areas or surfaces 56 each of which cooperates with only a portion of the applicator 46. When the portion of the applicator contacting the fuser roll becomes so toner laden as to lose its effectiveness as either an applicator or a cleaner the support member 48 can be reoriented such that a clean portion of the applicator is moved into alignment with the fuser roll structure. To accomplish such reorientation the oil pan 44 is removed from the fuser frame 57 by moving the pan from the right to left as viewed in FIG. 3.

A doctor blade 58 and support 60 therefore are disposed within the sump 44 such that the blade 58 contacts the fuser roll structure 16 after the oil has been applied by the applicator 46. The support 60 is provided with a pair of pin members 62 received in apertures in the sump 44. Spring members 64 received in standoffs 65 serve to bias the support 60 and therefore the blade 58 into contact with the fuser roll with sufficient force (i.e., 8 lbs. total) that the oil applied to the roll is metered to a thickness such that 6 $\mu$liters per copy of 8 ½ × 11 inch paper is utilized. The doctor blade which may be fabricated from any suitable material for such purposes, for example, a fluorosilicone elastomer having a durometer on the order of 80 Shore A, is received in an elongated channel 66 of the support member.

The backup roll 18 (FIGS. 2 and 3) which has approximately the same overall dimensions as the fuser roll structure 16 comprises a rigid, generally cylindrical member 68 having an outside diameter of 1 ¾inches and a three-sixteenths of an inch wall thickness and a pair of end caps 70 and 70' received in the terminal portions of the member 68. A 0.315 inch layer 72 of elastomeric material, preferably a heat-resistant, organosiloxane polymer commonly known as silicone rubber, is adhered to the member 68. A 0.019 inch outer layer or sleeve 74 of high heat-resistant material having a relatively low affinity for tackified toner is provided over the silicone rubber layer. The combined thickness and durometer of the layers 72 and 74 is such as to allow for deformation thereof by the fuser roll structure in order to yield a suitable length for the nip 36 (i.e., an area coextensive with the concave portion of the backup roll). A felt pad 75 and support 77 therefor are supported by the fuser assembly frame so that the pad contacts the surface of the backup roll. Thus, any contamination such as toner is removed from the backup roll during its rotation. The layer or sleeve 74 may comprise any suitable material exhibiting the desired properties, for example, it may comprise fluoronated ethylene proplyene, abbreviated FEP.

The end caps 70 and 70' of the backup roll 18 are supported in a pair of side frame or bracket members 76, 76' by bearings 78, 78'. The backup roll together with the bearings and frame members can be readily removed from the fuser assembly 12. To this end, the side frames 76, 76' are provided in the uppermost portions thereof with hook-like members 80, 80' which are received in recesses 82, 82' provided in a pair of pivot arms 84, 84'. The pivot arms support the backup roll for movement into and out of engagement with the fuser roll structure 16 in a manner to be discussed hereinafter. A pair of bolts 86, 86' fasten the lowermost portions of the side frames to the pivot arms 84, 84'. The pivot arms are supported by the machine frame through stub shafts 85.

To install the backup roll 18, the hook-like members 80, 80' are inserted into the recesses 82, 82' with subsequent installation of the bolts 86, 86'. To remove the backup roll the foregoing procedure is simply reversed. Both installation and removal of the backup roll can be accomplished quickly with a minimum of handling. The hook-like members 80, 80' replace bolts similar to the bolts 86, 86'. It should be appreciated that during removal of the backup roll when the bolts 86, 86' have been removed, the hook-like members support the backup roll on the pivot arms 84, 84' so that the backup roll need not be handled until after bolt removal. When the backup roll is hot the foregoing aspect of the backup assembly is significant. With prior art devices where four bolts are employed, it is necessary to handle the backup roll while removing the bolts.

Figure 4:
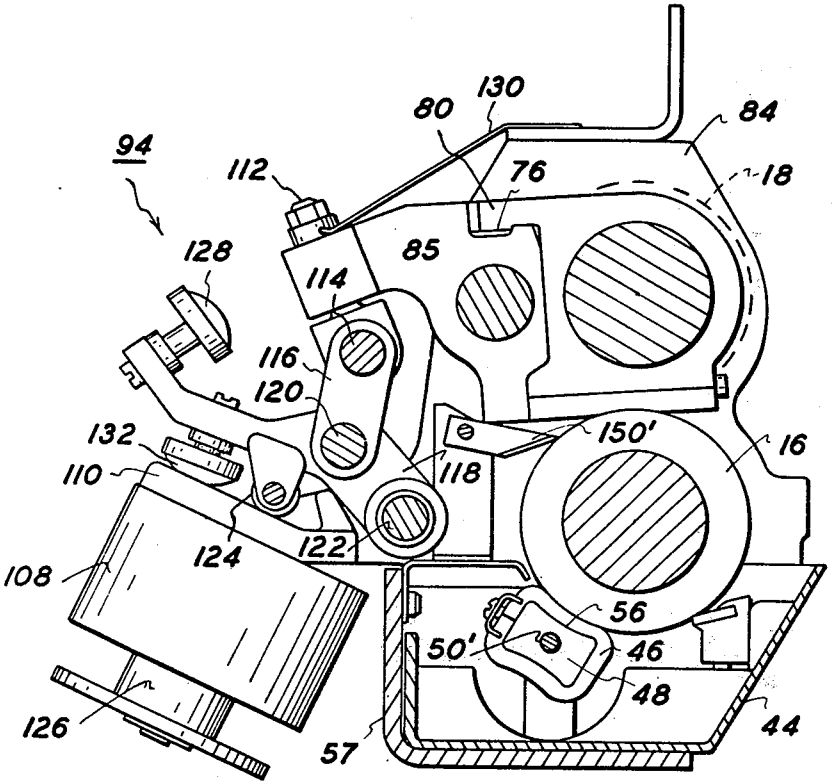
FIG. 4 is a side elevational view of the fuser forming the present invention with the backup roll and fuser rolls disengaged.

As viewed in FIG. 4, the fuser roll structure 16 and the backup roll 18 are supported out of engagement which corresponds to either an inoperative condition of the copier apparatus 9 or a warmup period which follows an initiation of the operation of the copier. The warmup period is required among other things in order to allow the fuser roll temperature to rise to a predetermined level suitable for fusing toner particles on the support member 34. When the rolls 16 and 18 are disengaged rotational movement of the backup roll 18 is accomplished by means of a flexible shaft 90 which couples a drive gear 88 to the backup roll 18. Rotational movement is imparted to the fuser roll structure 16 by virtue of the driven gear 30 meshing with the drive gear 88. A shear pin 91 or other safety drive device secured in the hub of the gear 88 is provided for drivingly coupling the gear to the main drive motor (not shown) of the machine via a chain (also not shown).

The ends of the flexible drive shaft 90 which are rectangular in cross-section are received in the end cap 70 and a clutch bearing 92, the latter of which is contained in the driven gear 88 for a purpose to be discussed hereinafter.

Figure 5:
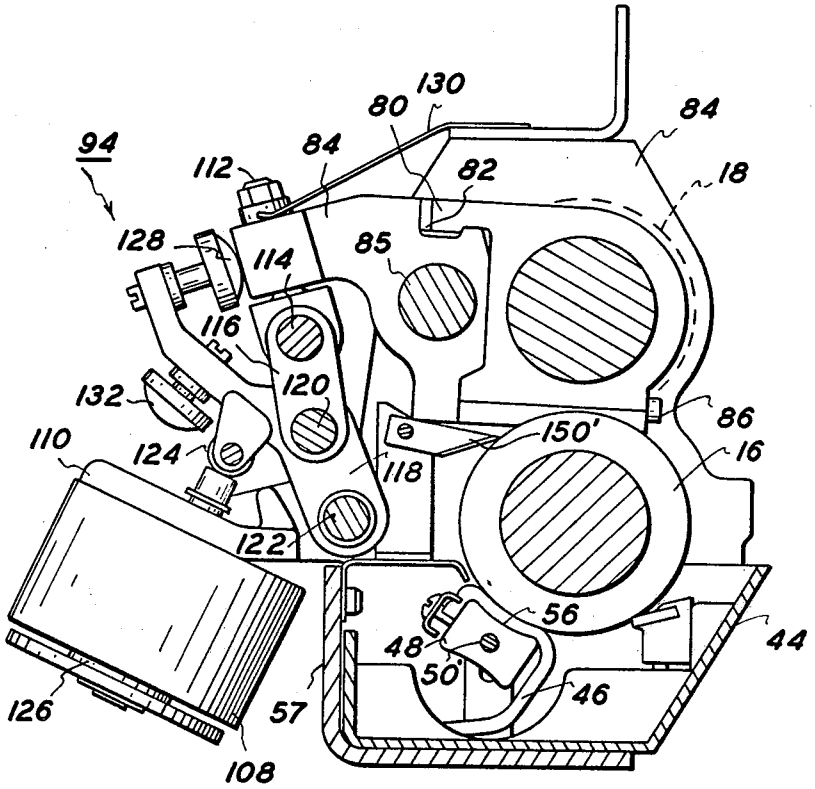
FIG. 5 is an elevational view of the fuser system similar to FIG. 4 but with the fuser roll and backup roll engaged.

The flexible drive shaft 90 allows for vertical displacement, as viewed in FIG. 2, of the backup roll 18 which displacement is effected by a latching or force generating mechanism generally indicated 94 (see FIGS. 4 and 5). During engagement of the backup roll and the fuser roll, the backup roll is driven by the fuser roll and the one-way clutch bearing 92 insures that the backup roll can be overdriven by the fuser roll.

While other flexible shafts may be employed, the specific shaft 90 contemplated can be obtained from Stow Manufacturing Co. under the designation Core No. Type 8990-1000. This particular shaft is fabricated by spirally winding wire rope to form a multi-layered structure having a generally cylindrical cross section. The ends of the shaft are crimped in order to form them into a generally square configuration. In operation the rotation of the shaft is in a direction which tends to tighten the windings thereof and therefore render the shaft more rigid yet sufficiently flexible to allow for the aforementioned displacement.

Figure 6:
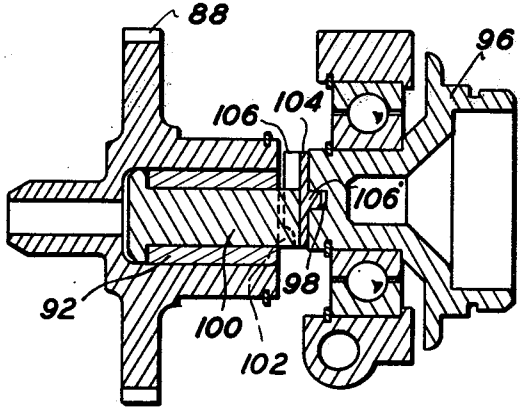
FIG. 6 is a fragmentary view of a flexible drive coupling.

A modified form of the flexible coupling 90, as illustrated in FIG. 6, comprises a double slider coupling commonly referred to as an Oldham coupling. In order to provide such an arrangement for coupling the backup roll to a drive gear, the end cap 70 is replaced by an end cap 96 having a slot 98 in the face thereof. A shaft support disposed internally of the clutch bearing 92 is replaced by coupling member 100 which has a slot 102 in the circular face thereof similar to the slot 98 but oriented at a 90° angle thereto. An interposer member 104 replaces the shaft 90 and drivingly couples the end cap 96 to the coupling member 100. To this end the interposer member comprises a generally cylindrical body portion having a tongue portion 106, 106′ formed integrally with each of the faces thereof. This type of coupling can, as in the case of the flexible shaft 90, permit displacement of the backup roll 18, but it also permits quick removal of the backup roll 18 from the fuser assembly.

The latching mechanism 94, as best viewed in FIGS. 4 and 5, comprises a four pivot linkage arrangement which is actuated by force generating means in the form of solenoid means 108 mounted on support bracket means 110 which is a part of the side frame members 26, 26′. Each of the pivot arms 84 supports a differential screw 112 which in turn supports a moving pivot member 114. The pivot member 114 operatively connects a link 116 to a link member 118 via a moving pivot 120 and a stationary pivot 122. The stub shafts 85 supporting the pivot arms 84, 84′ act as a stationary pivot and form one of the four pivots of the linkage arrangement.

The link 118 has affixed thereto a cam follower in the form of a roller 124. The core 126 of the solenoid 108 acts as a cam, bearing against the roller 124 to thereby effect clockwise rotation of the link 118 about the pivot 122. Simultaneously the moving pivot 120 moves to the right as viewed in FIG. 4 to a point that is substantially in a straight line with a line drawn through the center of the pivots 114 and 122. An adjustable bumper 128 acts as stop member by virtue of its contacting the pivot arm 84 as viewed in FIG. 5. In this manner the bumper 128 limits the degree of travel of the pivot 120 to a position just to the left of the aforementioned line drawn through the center of the pivots 114 and 122.

A pair of bias springs 130 (only one shown), one for each of the pivot arms, assist the forces exerted by the fuser roll structure 16 to effect disengagement of the backup from the fuser roll when the latching mechanism 94 is inoperative, in other words when the solenoid means 108 is de-energized. The springs apply a total of approximately 8 lbs. of force. It will be appreciated that the amount of force required of the solenoid to maintain the backup and fuser rolls in nip is quite small. The holding power requirement as opposed to the latching power requirement for the solenoid is on the order of 20 watts compared to 320 watts required for effecting engagement between the rolls so as to create a total force of 800 lbs. during hot nip (i.e., when the fuser roll is at or near its operating temperature). A second adjustable bumper or stop 132 integral with the link 118 limits the counterclockwise travel of the link 118 through its engagement with the solenoid means 108.

Adjustment of the latching mechanism 94 is effected through adjustment of the bumpers 128 and 132. With the solenoid energized the bumper 128 should contact the pivot arms 84, 84′ such that the center of the pivot 120 is just to the left of the center line through the pivots 114 and 122. If, when the solenoid is energized, the foregoing is not the case then the bumper 128 can be moved toward or away from the pivot arm, whichever is required.

Nip pressure can be varied through adjustment of the differential screw 112 once the latching mechanism has been adjusted. Suitable nip pressure is attained when the measured contact angle is equal to 0.45 in. This can be done with standard carbon paper utilized in accordance with established procedures for measuring the contact arc between the backup roll and fuser roll structure.

It will be appreciated that the force exerted by the fuser roll would normally tend to create a substantial shear force on the bolts 86, 86′. Consequently, the side frame members 76, 76′ are constructed so as to direct the aforementioned shear forces through the side frames in a direction so that these forces are directed against inclined surfaces 134 of the pivot arms 84, 84′.

The solenoid means 108 may consist of a single D.C. solenoid, size 8EC available from Ledex Corporation or may consist of a pair of D.C. solenoids, size 7EC also available from the Ledex Corporation.

As illustrated in FIG. 7, a torque transmission shaft 136 couples pivot arms 84, 84′, to insure proper latching by the latch mechanism 94. To this end, the lower portions of the pivot arms are provided with castellated protrusions 138, 138′ formed integrally therewith. The shaft 136 supports a pair of castellated collars 140, 140′ which cooperatively engage the protrusions 138, 138′ whereby motion imparted to either of the pivot arms is transmitted to the other of the arms. The collar 140 is secured to the shaft by a set screw 142 while the collar 140′ carries a set screw 142′ which rides in a slot 144 provided in the shaft 136. A coil spring 146 engages a retaining ring 148 and the collar 140′ in order to bias the collars into engagement with the protrusions 138, 138′. Removal of the shaft can be effected by simply moving it to the right, as viewed in FIG. 7, against the force of the spring 146.

Also illustrated in FIG. 7 are a pair of fingers 150, 150′ which as viewed in FIG. 3 are positioned adjacent the exit of the nip 36. The fingers effect removal of copy sheets 34 from the fuser roll structure 16. As the copy sheet leaves the nip it follows the rotation of the fuser roll structure, where it comes into contact with the upper surface of the stripper fingers. The fingers thus become interposed between the sheet and the fuser roll to thereby redirect the sheet along a predetermined path of travel away from the fuser roll so that it can be picked up by a transport (not shown). The finger may be fabricated from a TFE material or the upper surface thereof may be coated with TFE in order to minimize tendency for the copy to stick thereon or for toner to be offset thereto.

As illustrated in FIG. 3, a thermistor 152 and support 154 therefor are pivotally supported in contact with the fuser roll structure 16. The thermistor may comprise any suitable construction, for example, such as disclosed in U.S. patent application Ser. No. 364,178 filed May 25, 1973 in the name of David K. Pearce and assigned to the assignee of this invention. The temperature of the fuser roll structure can be controlled in conjunction with the output from the thermistor by a control circuit such as disclosed in U.S. Pat. No. 3,327,096.

The entire fuser assembly 12 is supported within the apparatus 9 by upper and lower slide structures and associated mounting brackets and hardware. Only the upper slide 160 is illustrated. Suitable slides are sold by the Accuride Co. and are identified by part number C-301-17- LC. The slide structures and associated brackets support the fuser assembly in a manner which enables sliding the assembly into and out of the machine in a direction coincident with the longitudinal extent of the rolls While the invention has been described with respect to the best made contemplated, it will be appreciated that various modifications may be made without departing from the spirit of the invention. Accordingly, it is not intended that the scope of the coverage sought be limited thereby.

What is claimed is:

1. Roll fuser apparatus for fixing toner images to copy sheets comprising;

a heated fuser roll structure;

a backup roll adapted to form a nip with said fuser roll structure through which said copy sheets move with said toner images in contact with said heated fuser roll structure;

means including a flexible coupling for imparting rotational movement to said backup roll, said flexible coupling operatively connecting one end of said backup roll with said means and extending in the direction of the longitudinal axis of said backup roll;

means operatively coupling said means, including a flexible coupling to said fuser roll structure for effecting rotational movement thereof; and means for effecting movement of said backup roll into engagement with said fuser roll structure, said flexible coupling being adapted to accommodate such movement of said backup roll.

2. Apparatus according to claim 1, wherein said flexible coupling comprises a flexible drive shaft.

3. Apparatus according to claim 1, wherein said flexible coupling comprises a double slider arrangement which accommodates said movement of said backup roll into engagement with said fuser roll structure and also accommodates removal of said backup roll from said apparatus.

4. Apparatus according to claim 3, including a release agent sump for applying release agent to said fuser roll structure, said fuser roll structure being disposed above said sump such that the ends thereof extend beyond said sump with said backup roll thereover; and wherein said drive means comprises a pair of meshing gears which are operatively coupled to said fuser roll structure and said backup roll, and are disposed beyond the ends of said sump to prevent contamination therefrom entering said sump.

5. Apparatus according to claim 1, wherein said means for effecting rotation of said backup roll and said fuser roll structure comprises a pair of meshing gears which cause rotation of said backup roll and said fuser roll structure prior to engagement thereof, and said flexible coupling is coupled to said backup roll and one of said meshing gears via aan overrunning clutch which prevents overdriving of the backup roll by the fuser roll after engagement thereof.

6. Apparatus according to claim 5, wherein said flexible coupling comprises a double slider arrangement comprising said one of said gears, an end cap forming a part of said backup roll and an interposer engaging said one of said gears and said end cap.

7. Apparatus according to claim 6, wherein said one of said gears and said end cap are provided each with a slot and said interposer has a pair of tongue portions insertable into said slots and disposed at approximately 90° relative to each other.

8. Apparatus according to claim 5, wherein said flexible coupling comprises a flexible shaft.

9. Copier apparatus including structure for forming total images on copy sheets and permanently affixing such images thereto wherein the means for permanently affixing the images to the copy sheet comprises, in combination:

a heated fuser roll structure;

a backup roll adapted to form a nip with said fuser roll structure through which said copy sheets move with said toner images in contact with said heated fuser roll structure;

means including a flexible coupling for imparting rotational movement to said backup roll, said flexible coupling means operatively connecting one end of said backup roll with said means and extending in the direction of the longitudinal axis of said backup roll;

means operatively coupling said means including a flexible coupling to said fuser roll structure for effecting rotational movement thereof; and means for effecting movement of said backup roll into engagement with said fuser roll structure, said flexible coupling being adapted to accommodate such movement of said backup roll.

10. Apparatus according to claim 9, wherein said drive means effects rotation of said backup roll and said fuser roll structure prior to engagement thereof and said flexible coupling is coupled to said backup roll and one of said meshing gears via an overrunning clutch which prevents overdriving of the backup roll by the fuser roll after engagement thereof.

11. Apparatus according to claim 10, wherein said flexible coupling comprises a double slider arrangement coupling said one of said gears, an end cap forming a part of said backup roll and an interposer engaging said one of said gears and said end cap.

12. Apparatus according to claim 11, wherein said one of said gears and said end cap are provided each with a slot and said interposer has a pair of tongue portions slidable in said slots and disposed at approximately 90° relative to each other.

* * * * *